US005653624A

United States Patent [19]

Ishikawa et al.

[11] Patent Number: 5,653,624

[45] Date of Patent: Aug. 5, 1997

[54] POLISHING APPARATUS WITH SWINGING STRUCTURES

[75] Inventors: Seiji Ishikawa, Yokohama; Norio Kimura, Fujisawa; Katsuyuki Aoki, Yokohama, all of Japan

[73] Assignee: Ebara Corporation, Tokyo, Japan

[21] Appl. No.: 527,422

[22] Filed: Sep. 13, 1995

[51] Int. Cl.[6] ..... B24B 5/00; B24B 29/00

[52] U.S. Cl. ..... 451/287; 451/285; 451/286; 451/288; 451/289; 451/290; 451/41

[58] Field of Search ..... 451/285–290, 451/41

[56] References Cited

U.S. PATENT DOCUMENTS

| | | | |
|---|---|---|---|
| 3,857,123 | 12/1974 | Walsh | 51/131 |
| 3,863,395 | 2/1975 | Brown | 51/121 |
| 4,141,180 | 2/1979 | Gill, Jr. et al. . | |
| 4,669,223 | 6/1987 | Schwar | 451/394 |
| 5,317,837 | 6/1994 | Stahli | 451/287 |
| 5,333,413 | 8/1994 | Hashimoto | 451/290 |
| 5,361,545 | 11/1994 | Nakamura | 451/290 |
| 5,435,772 | 7/1995 | Yu | 451/63 |
| 5,476,414 | 12/1995 | Hirose et al. | 451/288 |
| 5,486,131 | 1/1996 | Cesna et al. | 451/56 |

*Primary Examiner*—Robert A. Rose
*Assistant Examiner*—George Nguyen
*Attorney, Agent, or Firm*—Wenderoth, Lind & Ponack

[57] ABSTRACT

A compact polishing apparatus requires less operating space than a conventional polishing apparatus generally used for polishing semiconductor wafers. The present apparatus has a swing shaft to provide a swing motion to a pressing device including a top ring member. There are three ranges of swing motion, i.e. a polishing range which is a small motion range used for polishing a wafer within the confined area of a turntable, a receiving range which is a medium motion range used for loading/unloading of a wafer in an area beyond the turntable, and a standby range which is a large motion range used for moving the top ring member to a standby or rinsing position in an area beyond the turntable. Because of the swing-based arrangement of the components in the present apparatus, isolation of critical components is easily achieved, thus resulting in low maintenance costs and long service life of the present apparatus. These advantages offer significant cost savings in the management of polishing operations.

3 Claims, 5 Drawing Sheets

POLISHING APPARATUS WITH SWINGING STRUCTURES

BACKGROUND OF THE INVENTION

1. Field of the Invention

The present invention relates in general to polishing apparatuses, and relates in particular to a polishing apparatus for polishing an object such as a semiconductor wafer to a flat and mirror finish.

2. Description of the Related Art

With increasing high density integration of semiconductor devices, integrated circuits have become micro-sized, and interline spacing also has shown a steady trend of decreasing size.

For optical lithography based on less then 0.5 micrometer interline spacing, the depth of focus is shallow and requires high precision of object flatness for a focusing plane of a stepper. This requires that the wafer surface be made flat, and one of the measures for achieving flatness is polishing of the wafers with a polishing apparatus.

The type of polishing apparatus used in such applications comprises a turntable device and a top ring device, each device having a controllable rotational speed, in which the top ring exerts certain pressure on the turntable by way of an object to be polished disposed between the two devices to generate a mirror polish on the object.

FIGS. 5 and 6 show a conventional polishing apparatus. FIG. 5 is a vertical cross sectional view and FIG. 6 is a plan view. A top ring member 32 holds an object to be polished, such a semiconductor wafer, placed on a turntable 31. The top ring member 32 is supported on a top ring head 33. The top ring head 33 is supported on a sliding base 34 so as to provide a linear reciprocating motion on the sliding base 34 by being connected to a ball screw 37 which is driven by a motor 36 by way of a gear box 35. The turntable 31 is provided with a cover 38 and the top ring member 32 is provided with a top ring cover 39.

The movement of the top ring member 32 in the conventional polishing apparatus presented above is designed to move linearly within the turntable as well as in a range outside of the turntable. This design presents the following operational problems.

(1) As seen in FIG. 6, an object receiving location A11, a polishing position A12, a top ring rinsing position A13, serving also as the stand-by position for replacing a polishing cloth on the turntable, and an object demounting position A14 are all arranged in a straight line. For this reason, the sliding base 34 and the gear box 35 must also be positioned along the same line, and the consequence is that the entire apparatus occupies a fairly large space.

(2) The polishing solution used in polishing the object is generally a strong chemical ranging from a strong acid (pH 1) to a strong alkaline (Ph 12), and the resulting splashing and vapors arising from such polishing solutions tend to corrode the apparatus, which requires anti-corrosion protection. The cover 39 for the top ring head 33 provides such a corrosion protection, and cover 38 is used to separate a polishing chamber R1 from a drive housing chamber R2 for housing the driving devices for the top ring head 33 and the turntable 31. However, because the top ring head 33 moves linearly, it is necessary to provide a large cut-out 38*a* (length 1 and width w). Inevitably, some atmosphere containing the polishing solution vapors invades into the drive housing chamber R2. It may be possible to provide a seal in the cut-out 38*a*, but such a measure provides a complex sealing configuration and yet imperfect sealing effects for corrosion protection.

The overall result of using the conventional polishing apparatus is that the corrosion problem is not stopped and the life of the apparatus thereby is shortened in spite of costly maintenance efforts.

SUMMARY OF THE INVENTION

An objective of the present invention is to provide a polishing apparatus which is compact in overall design while providing isolation among the component devices by having easy and effective sealing means.

Such objective is achieved by the provision of a polishing apparatus including a turntable having a polishing cloth mounted on a top surface thereof and rotating at a first controlled rotational speed, a top ring member, operatively connected to a support shaft which is movable vertically disposed above the turntable for holding in a bottom portion thereof an object to be polished, and rotating at a second controlled rotational speed. A pressure means is fixed to the support shaft to apply a controlled pressure to the top ring member to press down the object onto the turntable. A swing motion device has a swing shaft for generating a swinging motion about the swing shaft to move the top ring member through a range of swing motion. Such swing motion range may be a small swing range in which the top ring member swings within a polishing range confined to an area of the turntable, a medium swing range in which the top ring member swings in a receiving range beyond the area of the turntable for loading and unloading of the polishing object, and a large swing range in which the top ring member wings in a standby range beyond the area of the turntable for a standby or rinsing operation.

The swing-based configuration of the present polishing apparatus enables not only all the requirements of the conventional polishing apparatus, such as pressing down the object into contact with the polishing cloth on the turntable, but also enables extra capabilities in a compact design.

The top ring member receives the object in the receiving range of swing motion which is beyond the confines of the turntable. The wafer is polished in the polishing range which is within the confines of the turntable. After the completion of polishing, the object is unloaded from the top ring member using the receiving range of the swing motion. The top ring member may then be moved to a standby position or be rinsed using the standby range of swing motion.

The swing motion device is located adjacent to the turntable, and includes a swing drive device contained in a drive housing chamber. This configuration not only allows a compact design of the apparatus, but also provides highly effective sealing of the drive device for corrosion protection thereof. A polishing chamber and the drive housing chamber can be isolated effectively and easily by providing a sealing device (rotating seal) around the swing shaft of the drive device.

The swing design of the present apparatus enables a compact and highly efficient polishing apparatus so that the operational area required for the polishing apparatus can be reduced. The sealing device provides highly effective isolation of the critical drive components from corrosion degradation caused by mist of polishing solution, thus providing low maintenance cost and contributing to a long service life of the polishing apparatus. The overall effect of the present apparatus is that managing of the polishing operation becomes efficient and cost-effective.

DESCRIPTION OF THE PREFERRED EMBODIMENT

Figure 1:
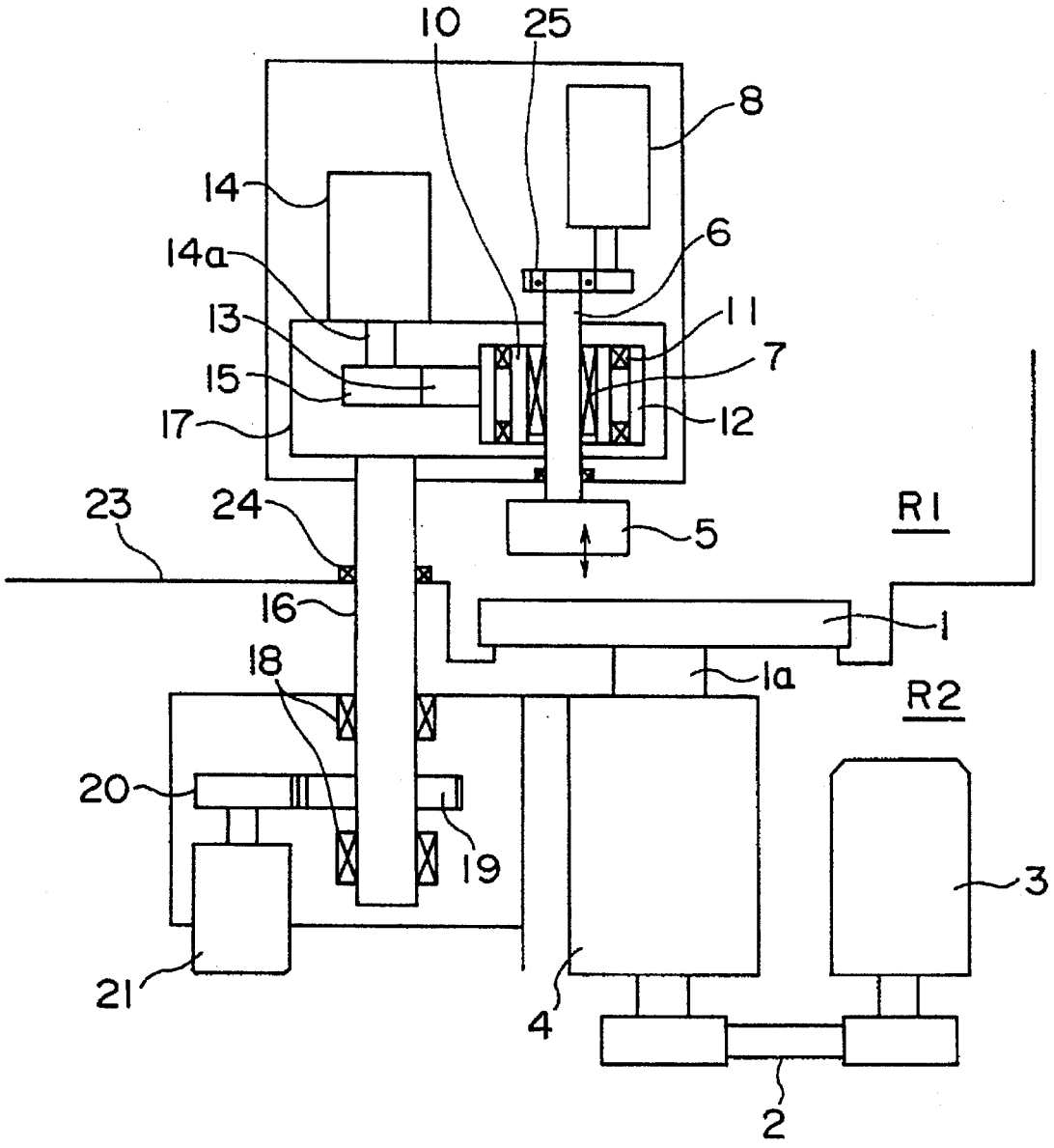
FIG. 1 is a schematic view of the overall configuration of an embodiment of the polishing apparatus of the present invention.

An embodiment of the present polishing apparatus will be explained with reference to FIGS. 1 to 4. FIG. 1 is a cross sectional view of the overall apparatus, FIG. 2 is a plan view of the present invention.

Figure 2:
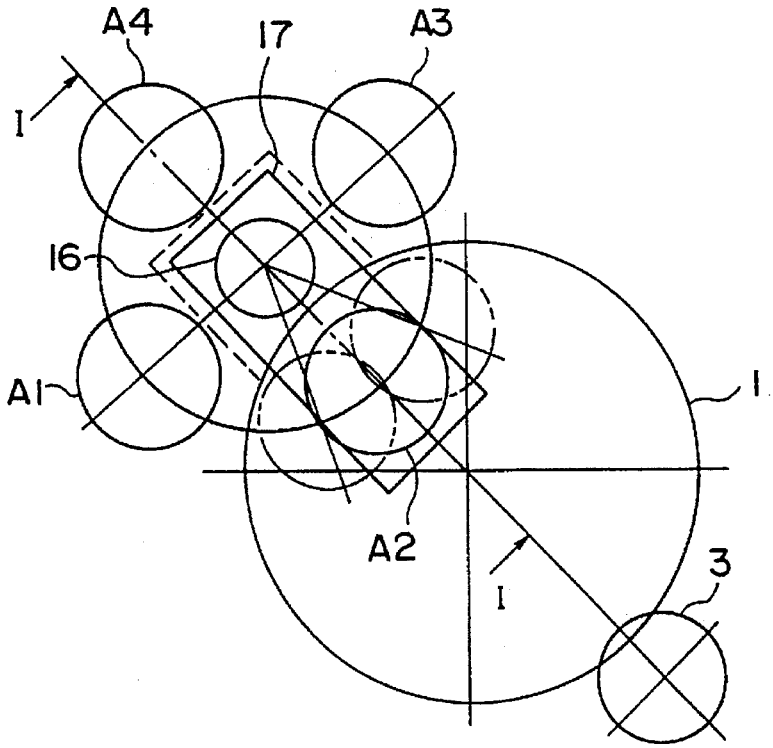
FIG. 2 is a plan view of the apparatus in FIG. 1.

In FIGS. 1 and 2, a turntable 1 is driven by a rotation shaft 1*a* which rotates the turntable 1 through a timing belt 2 connected to a turntable motor 3. The rotation shaft 1*a* is supported by a bearing base 4 having an internal bearing. A top ring member 5 is disposed above the turntable 1 for holding an object to be polished, such as a semiconductor wafer. The top ring member 5 is firmly supported by a support shaft 6 which is supported by a sliding bearing 7 to be vertically movable. The top end of the support shaft 6 is connected to a pneumatic cylinder 8 through a rotational coupling 25, and can be moved vertically by the pneumatic cylinder 8 so as to press the top ring member 5 onto the turntable 1.

Figure 3:
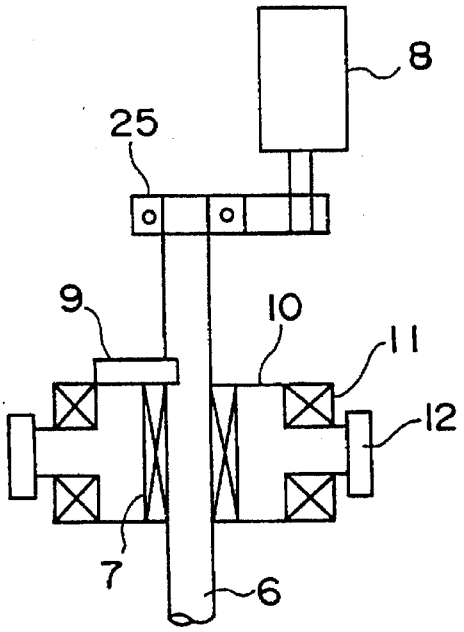
FIG. 3 is a partially enlarged cross sectional view of the polishing apparatus in FIG. 1.

The support shaft 6 is connected to a rotation cylinder 10 via a key 9, as shown in FIG. 3, and the rotation cylinder 10 is supportingly accommodated by a rotation bearing 11 and is provided with a timing pulley 12 at the outer periphery thereof. The timing pulley 12 is connected, by way of timing belt 13, to a timing pulley 15 fixed on rotation shaft 14*a* of a top ring member rotation motor 14 (refer to FIG. 1). It follows that, by operating the top ring member rotation motor 14, the rotation cylinder 10 and the support shaft 6 are rotated as a unit, by means of the timing pulleys 15, 12 and timing belt 13, together with the top ring member 5.

Outwardly of the turntable 1, there is disposed a swing shaft 16 whose top end is provided with a top ring head 17 supporting the top ring member 5, the support shaft 6, cylinder 8, motor 14 and cylinder 10. The bottom end of the swing shaft 16 is supported by upper and lower swing bearings 18 so as to be vertical or transverse to the plane of the surface of the turntable 1, and is connected to a swing drive motor 21 by way of the gears 19, 20. Therefore, by rotating the swing drive motor 21 in the clockwise or counter-clockwise direction, the swing shaft 16 is rotated, and the top ring member 5 swings about the swing shaft 16 by way of the top ring head 17. The swing drive motor 21 is a servo-motor which is controlled with a servo-motor control device to provide any desired number of rotations and rotational speed. A polishing chamber R1 is isolated from a drive housing chamber R2 by a cover 23 located above the table, and an opening in the cover 23 through which the swing shaft 16 passes is sealed off with a circular rotating seal 24.

Figure 4:
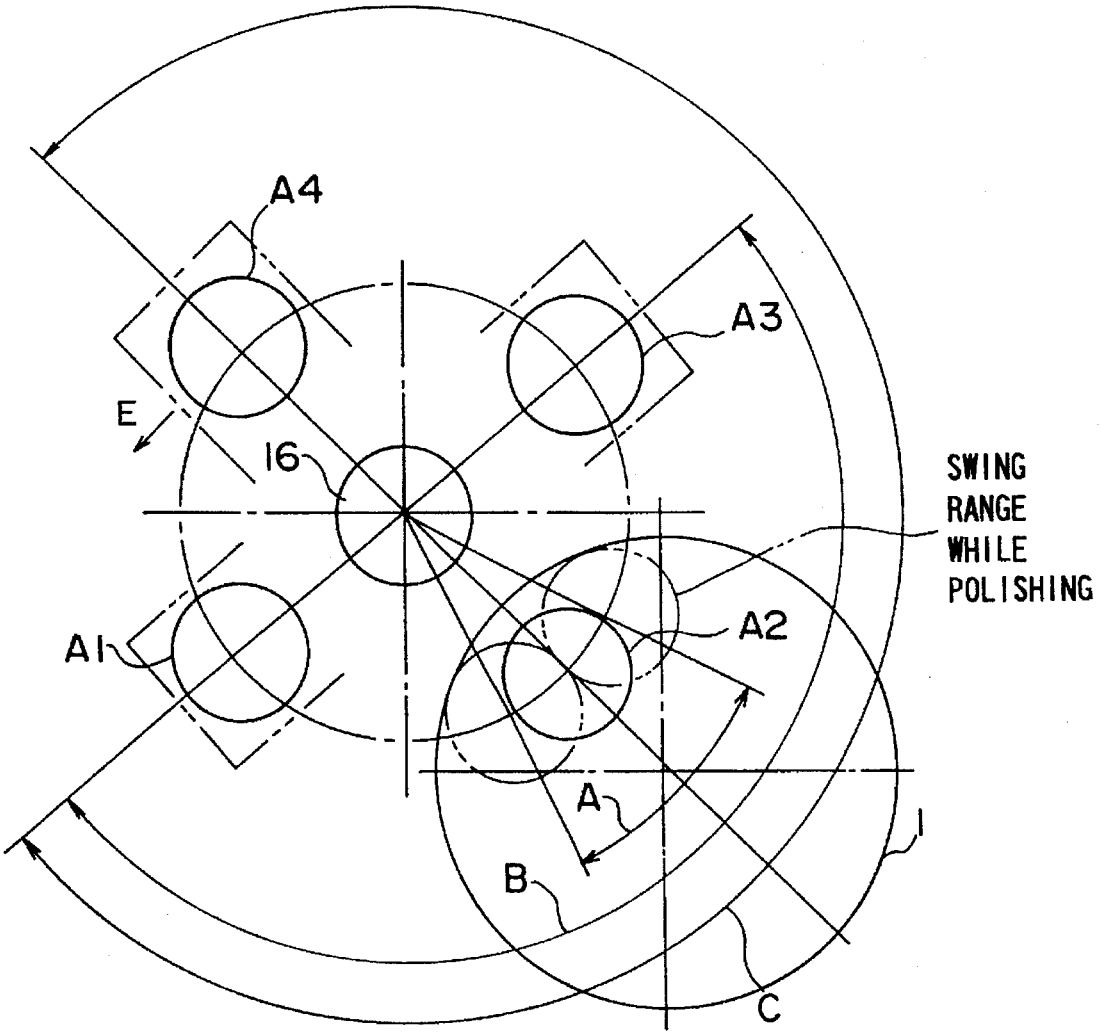
FIG. 4 is a diagram illustrating operation of the present polishing apparatus.
Figure 5:
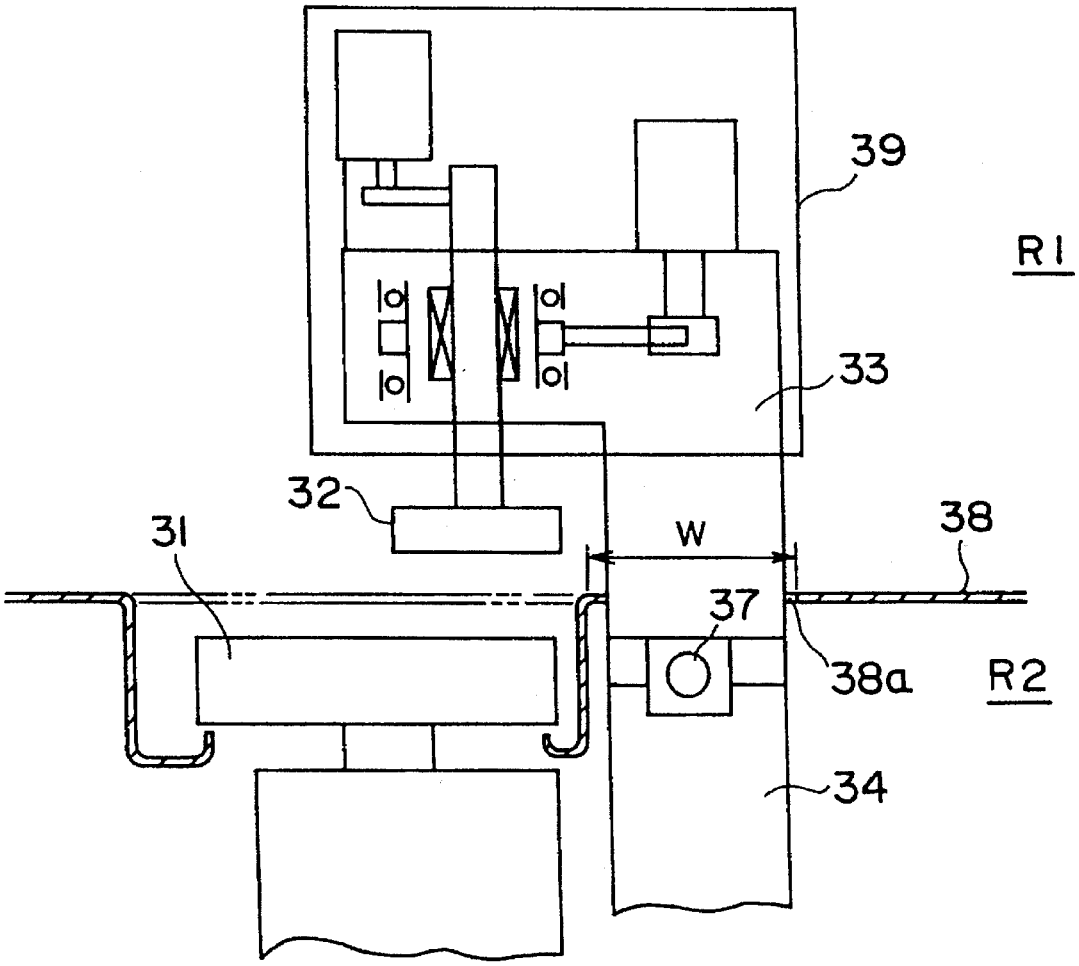
FIG. 5 is a cross sectional view of a conventional polishing apparatus.
Figure 6:
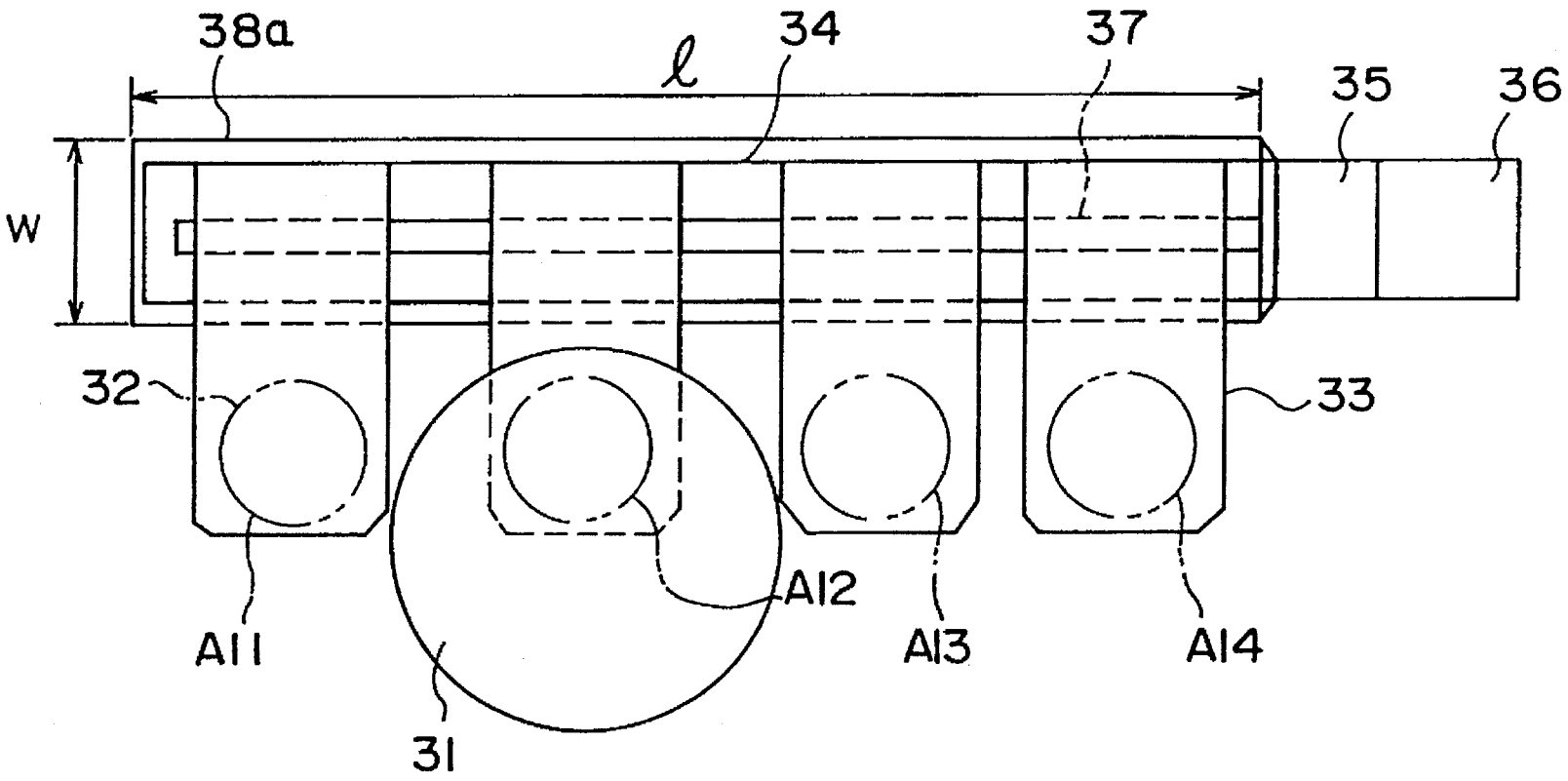
FIG. 6 plan view of the apparatus shoe in FIG. 5.

The operation of the polishing apparatus having the above structural configuration will be explained below with reference to FIG. 4. The swing motor 21 is rotated to rotate the swing shaft 16, and the top ring member 5 is moved through a given range of swing motion. Such motion of the top ring member 5 may be through three ranges, A, B and C. The first swing range A is a small swing range centered about a polishing position A2 while pressing down an object against the turntable 1. The second swing range B is an intermediate swing range which is between a receiving position A1 and an object detaching or discharging position A3 and exceeds the reach of the turntable 1. The third swing range C is a large range which is between the receiving position A1 and a standby position A4 which is used when rinsing the top ring member 5 or changing the polishing cloth on the turntable 1.

The object to be polished is provided to the apparatus at position A1, and the swing shaft 16 then is moved so that the top ring member 5 is located above the turntable 1. At this time, the pneumatic cylinder 8 is operated to press the object down onto the turntable 1, and motor 21 is operated to swing the top ring member 5 about position A2 in small swing range A to perform polishing. Next, the top ring member 5 is swung over the swing range B to position the object in the detaching position A3 to enable the polished object to be removed. Next, the top ring member 5 is swung over large swing range C to rinse the top ring member 5 at the position A4. Still in the swing range C, the top ring member 5 is moved back to the receiving position A1 where the next object to be polished will be loaded onto the top ring member 5. After the rinsing step, it is also possible to take a route E shown by the arrow in FIG. 4 to return the top ring member 5 to the receiving position A1.

The embodiment presented above demonstrates that the configuration of the top ring member with respect to the turntable makes it possible to produce a compact and efficient polishing apparatus compared with the conventional polishing apparatus. Such a compact apparatus occupies less space, which contributes to a cost-effective operation of producing semiconductor devices. The isolation achieved is effective in prolonging the service life of the components of the polishing apparatus, again contributing to lowering the cost of device production.

The above embodiment has been illustrated with respect to a particular choice of components and arrangement of the components, but such embodiment is meant to be illustrative and not to restrict the present invention in any way. Other drives and arrangements of the components can be employed within the concept of the present invention.

What is claimed is:

1. A polishing apparatus for polishing objects, said apparatus comprising:

a turntable having a top surface having thereon a polishing cloth;

a swing shaft adjacent said turntable and having a vertical longitudinal axis, said swing shaft being mounted for rotation about said axis and being fixed axially thereof;

a top ring head immovably fixed to said swing shaft and rotatable therewith about said axis thereof;

a support shaft having thereon a top ring member operable to hold an object to be polished, said support shaft being mounted on said top ring head for rotation therewith about said axis of said swing shaft, for rotation about a vertical axis of said support shaft and for vertical movement relative to said top ring head;

pressure means operably connected to said support shaft to move said support shaft vertically relative to said top ring head, and thereby to move vertically said top ring member and an object held thereby;

a first motor fixedly mounted on said top ring head;

a transmitting mechanism operable to transmit rotation of an output shaft of said first motor to said support shaft, and thereby rotate said support shaft and said top ring member about said axis of said support shaft; and a second motor operably connected to said swing shaft to rotate said swing shaft about said axis thereof to swing said top ring head about said axis of said swing shaft to selectively move said top ring member to a receiving position, at which said top ring member is movable vertically to receive and hold an object, to a position at said turntable, at which said second motor rotates said swing shaft to cause said top ring head and said top ring member to oscillate about said axis of said swing shaft to polish the object, to a detaching position, at which said top ring member releases the object, and to a rinsing position, at which said top ring member may be rinsed.

2. A polishing apparatus as claimed in claim 1, wherein said turntable is rotated at a speed independent of a speed of rotation of said top ring member achieved by said first motor and said transmitting mechanism.

3. A polishing apparatus as claimed in claim 1, further comprising a cover separating a drive housing chamber within which is housed said second motor from a polishing chamber within which is performed polishing of objects, said cover having therethrough an opening through which extends said swing shaft, and a seal sealing said opening around said swing shaft and isolating said drive housing chamber from said polishing chamber.

* * * * *